US011523675B2

(12) United States Patent
Heinemark et al.

(10) Patent No.: US 11,523,675 B2
(45) Date of Patent: Dec. 13, 2022

(54) TOOL HOLDER

(71) Applicant: HUSQVARNA AB, Huskvarna (SE)

(72) Inventors: Carl Heinemark, Tenhult (SE); Mikael Arvidsson, Jönköping (SE)

(73) Assignee: HUSQVARNA AB, Huskvarna (SE)

( * ) Notice: Subject to any disclaimer, the term of this patent is extended or adjusted under 35 U.S.C. 154(b) by 140 days.

(21) Appl. No.: 16/766,135

(22) PCT Filed: Dec. 21, 2018

(86) PCT No.: PCT/EP2018/086548
§ 371 (c)(1),
(2) Date: May 21, 2020

(87) PCT Pub. No.: WO2019/129699
PCT Pub. Date: Jul. 4, 2019

(65) Prior Publication Data

US 2020/0359775 A1 Nov. 19, 2020

(30) Foreign Application Priority Data

Dec. 29, 2017 (SE) ..... 1751669-1

(51) Int. Cl.
*A45F 5/02* (2006.01)

(52) U.S. Cl.
CPC ..... *A45F 5/021* (2013.01); *A45F 2200/0575* (2013.01)

(58) Field of Classification Search
CPC .... A45F 5/021; A45F 2200/0575; B25H 3/00
See application file for complete search history.

(56) References Cited

U.S. PATENT DOCUMENTS 3,992,776 A 11/1976 Koppe et al.
4,325,503 A * 4/1982 Swinney ..... B44D 3/24 224/268
4,757,927 A 7/1988 Rutty
5,024,018 A * 6/1991 Ferrigno ..... A01K 97/10 224/672

(Continued)

FOREIGN PATENT DOCUMENTS

DE 20011898 U1 11/2000
FR 2731598 A1 9/1996

OTHER PUBLICATIONS

International Search Report and Written Opinion for PCT Application No. PCT/EP2018/086548, dated May 22, 2019.

(Continued)

*Primary Examiner* — David M Upchurch
(74) *Attorney, Agent, or Firm* — Burr & Forman, LLP

(57) ABSTRACT

A tool holder for a tool belt may include a flexible carrier sheet and at least one belt hanger. The at least one belt hanger may include a belt interface which may be configured to be connected to a tool belt and a carrier sheet connection interface which may be configured to be connected to the carrier sheet. The flexible carrier sheet may include a tool suspension interface which may be configured to connect to a tool or a tool receiver, and a hanger connection interface which may be configured to connect to the carrier sheet connection interface of the belt hanger. The carrier sheet may be configured to connect to the belt hanger by bending the hanger connection interface.

11 Claims, 9 Drawing Sheets

(56) References Cited

U.S. PATENT DOCUMENTS 5,388,740 A * 2/1995 Garland ..... B26B 29/025 224/675
5,497,921 A * 3/1996 Dancyger ..... B44D 3/14 224/907
6,085,952 A * 7/2000 Garland ..... B26B 29/025 224/907
D455,901 S * 4/2002 Snider ..... D3/228
6,382,481 B1 * 5/2002 McIlmoil ..... A45F 5/004 224/245
6,641,011 B1 * 11/2003 Kahn ..... A45F 5/02 224/904
8,418,309 B1 * 4/2013 Williams ..... B44D 3/126 220/570
9,427,069 B1 * 8/2016 Carver ..... A45F 5/02
9,463,662 B1 * 10/2016 Sotolongo ..... B44D 3/126
9,469,438 B2 * 10/2016 Nool ..... A61G 13/101
2002/0185509 A1 * 12/2002 Wichman ..... A45F 5/00 224/679
2004/0079776 A1 * 4/2004 Bauer ..... A45F 5/02 224/269
2004/0118722 A1 6/2004 Martin
2004/0232187 A1 * 11/2004 Zega ..... A45F 5/00 224/672
2007/0045364 A1 * 3/2007 Grundy ..... F41C 33/02 224/666
2007/0125819 A1 * 6/2007 Kahn ..... B25H 3/006 224/904
2009/0206098 A1 * 8/2009 Garahan ..... A45F 5/02 220/737
2014/0007408 A1 * 1/2014 Nool ..... A61M 5/1418 29/525.01
2014/0291362 A1 * 10/2014 Victor ..... A45F 5/00 224/222
2015/0021372 A1 1/2015 Moreau et al.
2015/0068936 A1 * 3/2015 Huang ..... A45F 5/021 206/349
2017/0105511 A1 * 4/2017 Bryant ..... A45C 13/10

OTHER PUBLICATIONS

Swedish Search Report in Swedish patent application No. 1751669-1, dated Jun. 29, 2018.

* cited by examiner

Fig. 4C
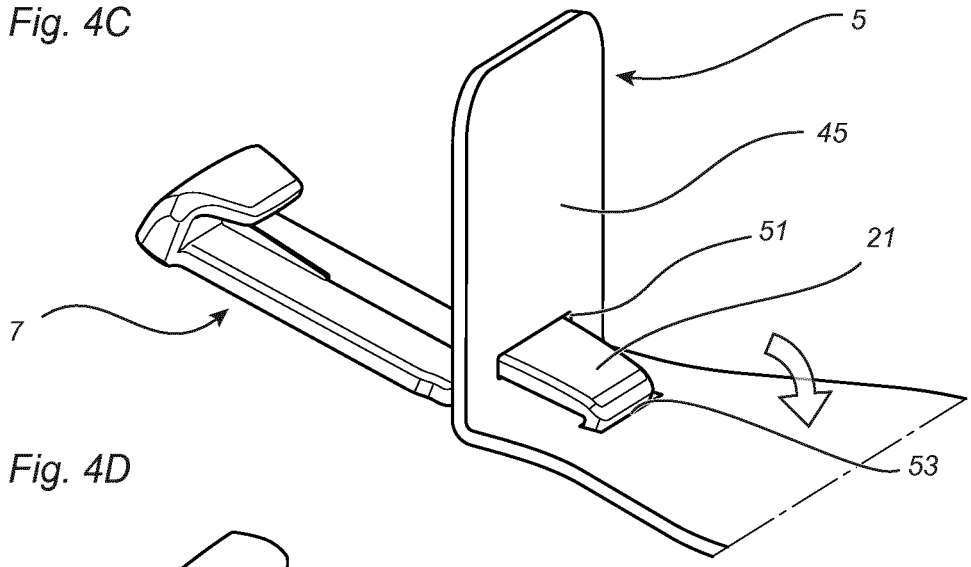
Fig. 4D
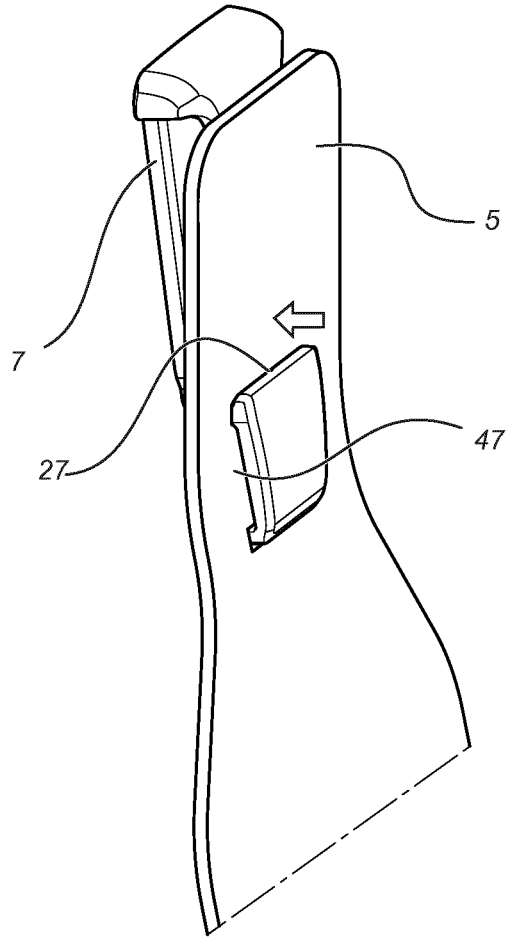
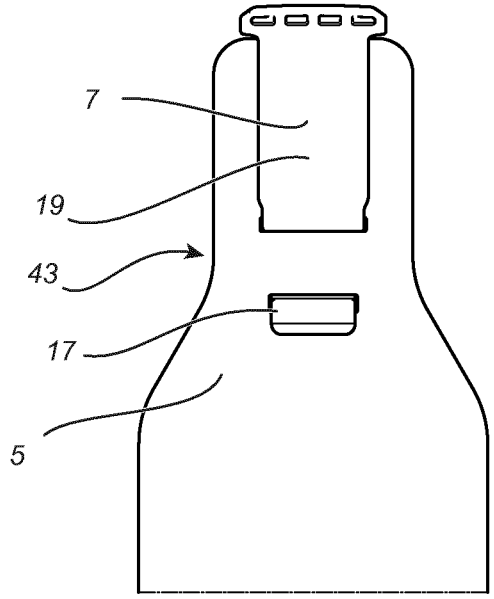
Fig. 4E

TOOL HOLDER

FIELD OF THE INVENTION

The present invention relates to a tool holder for a tool belt, especially to a tool holder comprising a belt hanger and a carrier sheet.

BACKGROUND OF THE INVENTION

In many professions workers often use waist tool belts to carry their tools and equipment. Specialized receivers, such as receptacles, pockets, hocks, holders and so forth are attached to the tool belt for carrying of the tools and equipment. These receivers are often manufactured with a loop or aperture through which the tool belt is pulled and in this manner the belt and the receivers can be worn around the waist of the user. To be able to rearrange or disconnect the receivers from the belt it is necessary to remove the belt from the waist and disengage the receivers from the belt and rearrange. Another disadvantage with these receivers is that the receivers can slide along the length of the belt and thus end up in the way of the user during work or angled such that the contents in the receivers fall out and are difficult for the user to reach.

SUMMARY

It is an object of to solve, or at least mitigate, parts or all the above-mentioned problems. To this end, there is provided a tool holder for a tool belt comprising a flexible carrier sheet and at least one belt hanger. The at least one belt hanger may comprise a belt interface configured to be connected to a tool belt and a carrier sheet connection interface configured to be connected to the carrier sheet. The flexible carrier sheet may comprise a tool suspension interface configured to be connected to a tool or a tool receiver, and a hanger connection interface configured to be connected to the carrier sheet connection interface of the belt hanger. The carrier sheet may be configured to be connected to the belt hanger by bending the hanger connection interface. The flexible carrier sheet is thus bendable at the hanger connection interface. This provides for a simple and inexpensive solution for a tool holder that can be connected to a tool belt where the parts of the tool holder are connected and disconnected to or from each other without using any tools. It is possible to have more than one belt hanger connected to the carrier sheet depending on the size of tool receiver or the weight of the tool that is connected to the carrier sheet.

The hanger connection interface may comprise an upper slot and a lower slot arranged, when carried suspended in a tool belt, one above the other along the vertical length of the carrier sheet. The carrier sheet connection interface may comprise a vertically lower portion and a vertically upper portion configured to extend along a first side face of the carrier sheet, and an intermediate portion interconnecting the vertically upper and lower portions, wherein the intermediate portion is offset relative to the vertically upper and lower portions to extend, when connected, along a second side face of the carrier sheet, the second side face being opposite to the first side face. The intermediate portion may be configured to be positioned between the upper and lower slot by bending the hanger connection interface. The design with the intermediate portion on a second side face of the carrier sheet and the vertically upper and lower portions on the opposite side face of the carrier sheet, creates a self-locking between the belt hanger and the carrier sheet when they are connected to each other by bending the hanger connection interface. The carrier sheet may bend around a bend axis which is parallel to the plane of the sheet.

The belt hanger may comprise an upper and a lower leg. The upper leg may connect the intermediate portion with the vertically upper portion, and the lower leg may connect the intermediate portion with the vertically lower portion. Hence, the carrier sheet connection interface may be formed as a single piece, where the upper and lower leg creates the offset position of the intermediate portion in relation to the vertically upper and lower portions.

The upper leg may be configured to be positioned in the upper slot and the lower leg may be configured to be inserted through the lower slot when the carrier sheet is connected to the belt hanger. Hence, the intermediate portion of the belt hanger will be arranged between the slots of the carrier sheet creating the self-locking. If a tool or a tool receiver is connected to the carrier sheet, the weight of the tool strives to drag the carrier sheet to a flat/straight position, preventing self-disconnection of the carrier sheet from the belt hanger. Alternatively, or additionally, intrinsic resilience of the carrier sheet may strive to bring the carrier sheet to a flat position, resulting in the same kind of self-locking.

The intermediate portion may further comprise at least one ridge, configured to secure the carrier sheet to the belt hanger by pressing or bending the hanger connection interface over the at least one ridge. This locks the carrier sheet against the belt hanger and prevents the carrier sheet from being disconnected from the belt hanger without the same type of folding as for connection of the carrier sheet to the belt hanger. The ridge, which may be continuous or intermittent, may extend vertically upwards or downwards from a horizontal leg portion interconnecting the intermediate portion with the upper or lower portion.

The belt interface may comprise a hook provided with a suspension edge extending, when in use, vertically downwards from a top portion of the belt hanger, wherein the suspension edge is configured to be hung around an upper part of the tool belt. This enables the tool holder to be hung and moved anywhere around the tool belt.

The carrier sheet may further comprise a top portion configured to secure the belt hanger to the tool belt when the belt hanger is connected to the tool belt by bending and inserting the top portion of the carrier sheet behind the suspension edge. This provides a simple and cheap solution to lock the tool holder to the tool belt and prevents the tool holder from sliding along the length of the tool belt, and a slim design, that doesn't require any further parts and does not prevent the user from moving freely during work.

The belt interface may further comprise a gripping element configured to engage with the tool belt to clamp the tool belt to the belt hanger when the belt hanger is connected at the tool belt. The gripping element may be configured as one or several protrusions, such as one or several ridges, facing a flat side of the belt. The top portion of the carrier sheet may be configured to squeeze the belt against the gripping element when the top portion of the carrier sheet is inserted behind the suspension edge. Hence, the tool holder is further prevented from sliding sideways along the length of the tool belt.

The belt hanger may be rigid. A single piece of material may form the belt hanger. For example, the belt hanger may be an integrally molded piece of plastic. It should preferably be dimensioned to handle the load from tools that are connected to the carrier sheet without breaking.

The tool suspension interface may comprise several attachment points adapted for connection of a tool or a tool receiver to the carrier sheet. The tool or tool receiver may be connected to the carrier sheet by several screws or rivets. The attachment points may be evenly spaced around the circumference of the carrier sheet, below the slots, for evenly distribution of the weight from the tools.

The object is also at least partly achieved by means of a method for connecting a tool holder to a tool belt, the tool holder comprising a flexible carrier sheet and at least one belt hanger. The method comprises the steps of: inserting an end of the belt hanger through an upper slot in the flexible carrier sheet, bending the flexible carrier sheet towards the belt hanger, inserting said end of the belt hanger through a lower slot in the flexible carrier sheet, straightening the bent flexible carrier sheet, hanging a suspension edge of the belt hanger around an upper edge of the tool belt, and inserting a top portion of a flexible carrier sheet behind the suspension edge, between the suspension edge and the tool belt.

To avoid unnecessary repetition, reference is made to the above discussion of advantages of the tool holder.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, where the same reference numerals will be used for similar elements, wherein:

FIGS. 4A-4E show perspective views of how the flexible carrier sheet is connected to the belt hanger.

DETAILED DESCRIPTION OF THE EXEMPLARY EMBODIMENTS

Figure 1A:
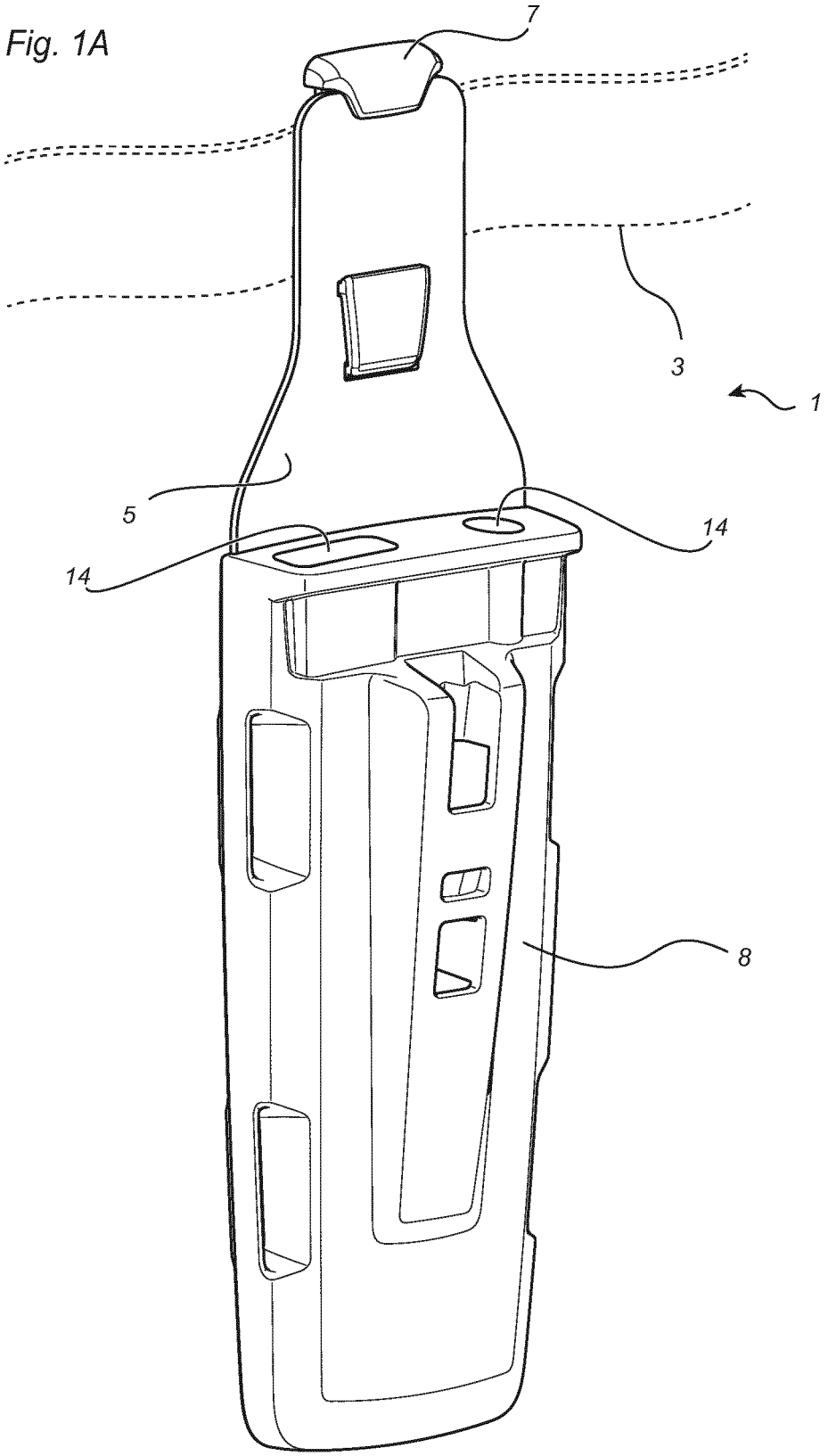
FIG. 1A shows a perspective view of a tool holder according to a first embodiment.
Figure 1B:
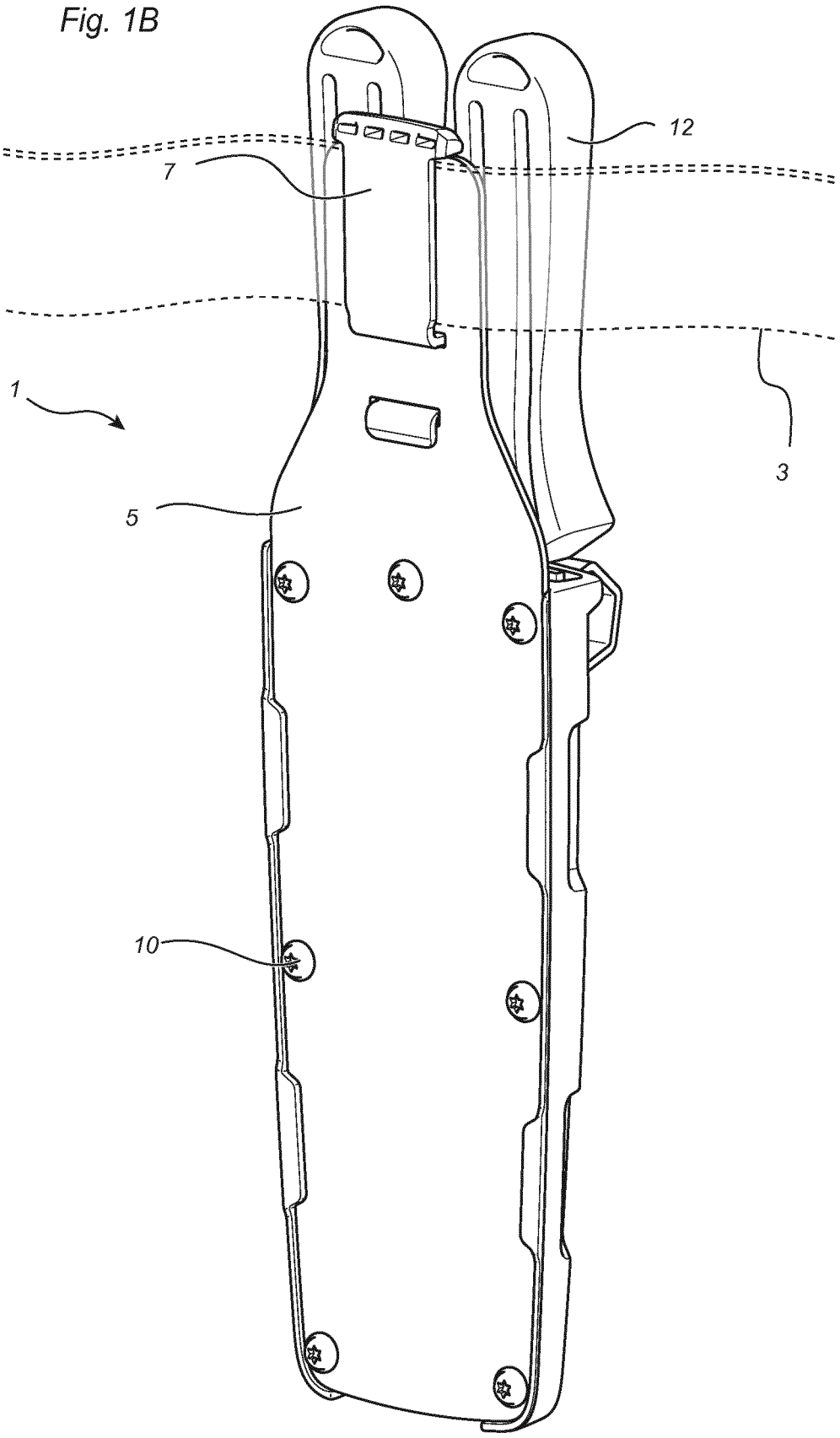
FIG. 1B shows a perspective view of the tool holder of FIG. 1A as seen from another perspective.

FIGS. 1A and 1B illustrate a tool holder 1 connected to a tool belt 3 according to a first embodiment. For clarity of illustration, the tool belt 3 is illustrated transparent, such that all parts of the tool holder 1 are visible from both perspectives. The tool holder 1 comprises a flexible carrier sheet 5 and at least one belt hanger 7. A tool receiver, configured as a receptacle 8 (FIG. 1A), is attached to the flexible carrier sheet by means of screws 10 (FIG. 1B), and chainsaw service tools, such as a pair of files 12 (FIG. 1B), may be inserted in slots 14 (FIG. 1A) of the receptacle 8.

Figure 2:
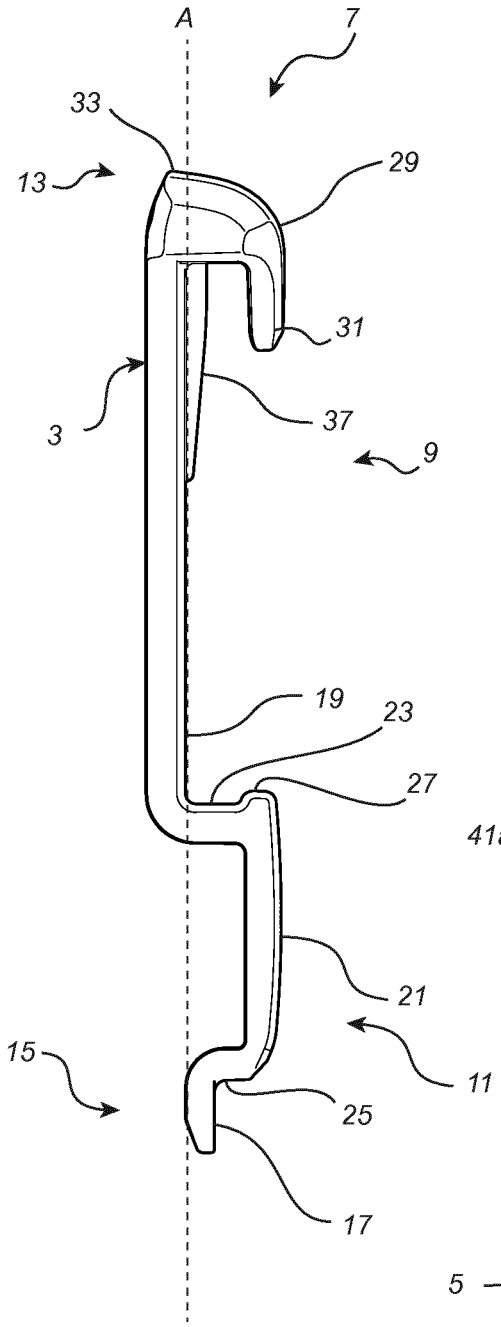
FIG. 2 shows a side view of a belt hanger.

A more detailed view of the belt hanger 7 is shown in FIG. 2, which illustrates the belt hanger 7 as it is oriented during normal use, when vertically suspended from a tool belt. The belt hanger 7 may comprise a belt interface 9 and a carrier sheet connection interface 11. The belt interface 9 is configured to be connected to the tool belt 3 (FIG. 1A) and the carrier sheet connection interface 11 is configured to be connected to the carrier sheet 5.

The belt hanger 7 may be rigid. It can be integrally formed. By way of example, it may be moulded as a single piece of plastic. The belt interface 9 may be arranged at a vertically upper end 13 of the belt hanger 7 and the carrier sheet connection interface 11 may be arranged at a vertically lower end 15 of the belt hanger 7.

The carrier sheet connection interface 11 may comprise a vertically lower portion 17, a vertically upper portion 19 and an intermediate portion 21 inter-connecting the vertically upper and lower portions 19, 17.

The belt hanger 7 may comprise an upper leg 23 and a lower leg 25, which extend in the horizontal direction. The upper leg 23 connects the intermediate portion 21 with the vertically upper portion 19 and the lower leg 25 connects the intermediate portion 21 with the vertically lower portion 17. These two legs 23, 25 provide a lateral displacement of the intermediate portion 21 relative the vertically upper and lower portions 19, 17. The intermediate portion 21 is thus offset laterally in relation to a vertical plane A of the belt hanger 7. The lower leg 25 may be shorter than the upper leg 23, wherein the vertically lower portion 17 may be slightly offset laterally in relation to the vertical plane A of the belt hanger 7. Thereby, the thickness of the tool belt 3 (FIG. 1A) is compensated for, which will be apparent from FIGS. 5A-C. The intermediate portion 21 may further comprise at least one ridge 27. The ridge 27 may be arranged at the connection point between the upper leg 23 and the intermediate portion 21.

The belt interface 9 may comprise a hook 29 provided with a suspension edge 31 extending, when in use, vertically downwards from a top portion 33 of the belt hanger 7. The suspension edge 31 is configured to be hung around an upper part 35 of the tool belt 3 (cf FIG. 5C). The belt interface 9 may also comprise a gripping element 37 configured to engage with the tool belt 3 to clamp the tool belt 3 to the belt hanger 7 when the belt hanger 7 is connected at the tool belt 3. The gripping element 37 may be configured as a ridge extending vertically downwards from the top portion 33 of the belt hanger 7.

Figure 3:
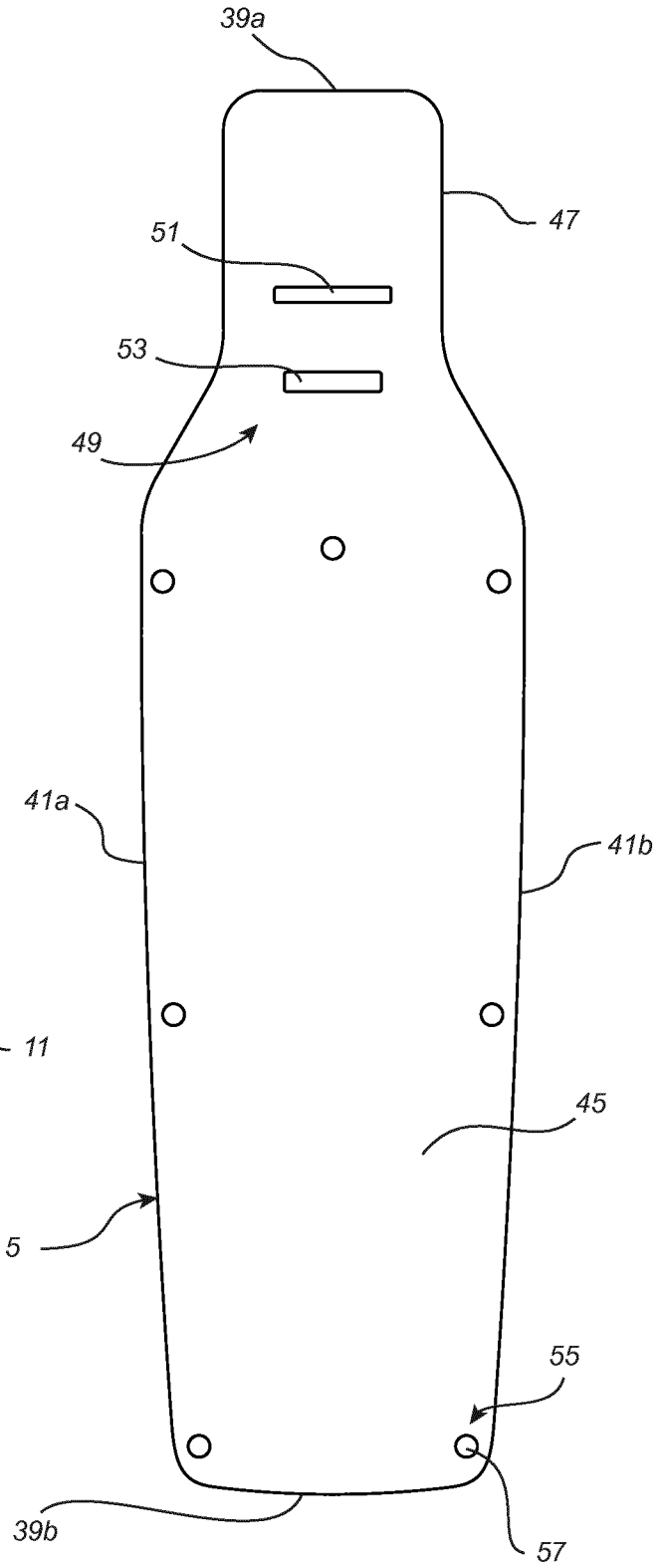
FIG. 3 shows a front view of a flexible carrier sheet.

The flexible carrier sheet 5 is shown in more detail in FIG. 3, which illustrates the carrier sheet 5 as it is oriented during normal use, when vertically suspended from a tool belt. The carrier sheet 5 can be made of a flexible but sturdy material, By way of example, it may be formed of a sheet of polymer, which may be reinforced by a fabric. The carrier sheet 5 can have the approximate shape of a rectangle with upper and lower short side edges 39*a*, 39*b*, two long side edges 41*a*, 41*b*, a first side face 43 (not visible in FIG. 3) and a second side face 45 opposite to the first side face 43. It may have a tapered upper portion 47. A hanger connection interface 49, configured to be connected to the carrier sheet interface 11 of the belt hanger 7 may be arranged at this tapered portion 47. The hanger connection interface 49 may comprise an upper slot 51 and a lower slot 53 arranged, when carried suspended in the tool belt 3, above each other along the vertical length of the carrier sheet 5. The slots 51, 53 are elongate, their longitudinal directions extending substantially horizontally, and a vertical distance between the slots corresponds to a vertical distance between the legs 23, 25 of the belt hanger 7. A tool suspension interface 55, configured to be connected to a tool or a tool receiving interface, may also be arranged on the carrier sheet 5. This tool suspension interface 55 may comprise of several attachment points 57, adapted for connection of a tool or a tool receiver to the carrier sheet 5. These attachment points 57 may be arranged around the perimeter of the carrier sheet 5. In this way, the weight of connected tools can be evenly distributed over the entire surface of the carrier sheet 5.

Figure 4A:
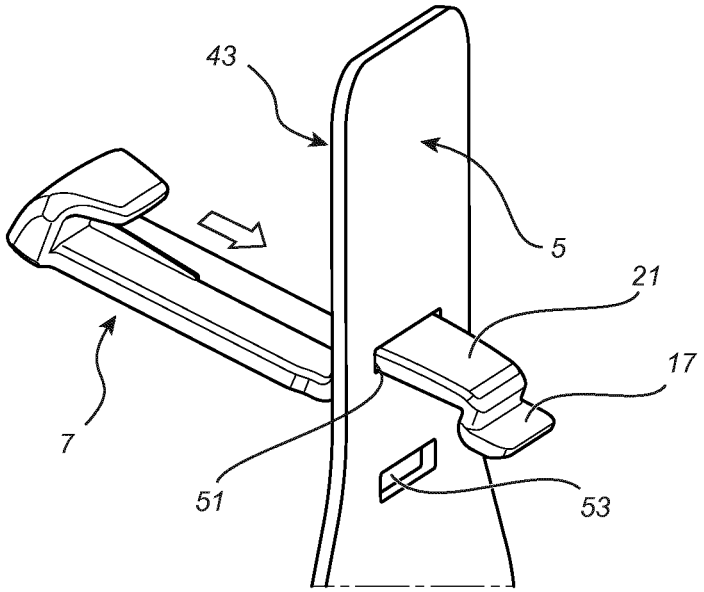
Figure 4B:
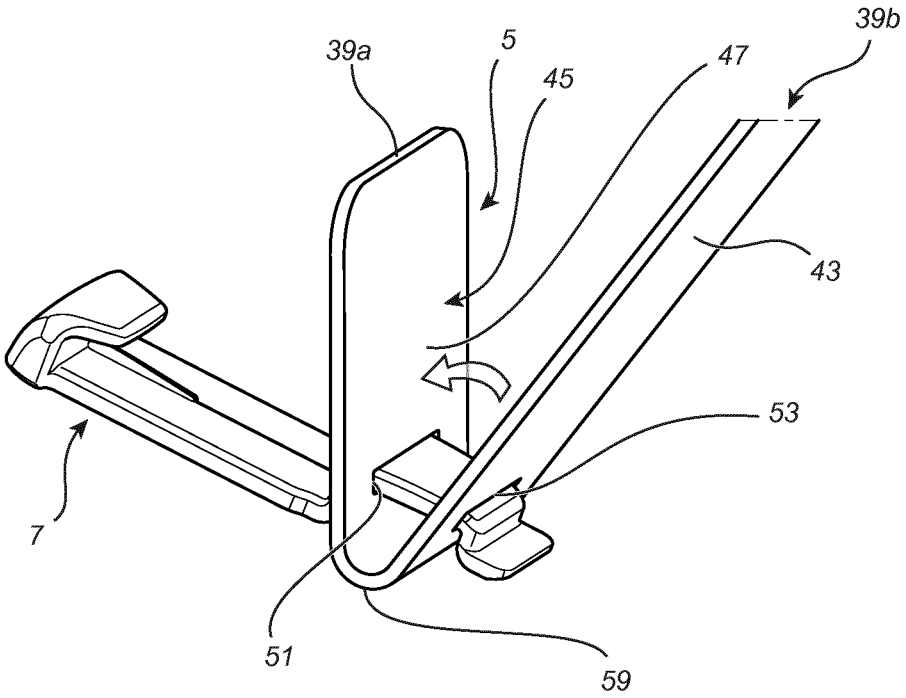

The connection of the flexible carrier sheet 5 to the belt hanger 7 is shown in FIGS. 4A-4D. The vertically lower portion 17 and a part of the intermediate portion 21 of the belt hanger 7 may be inserted from the first side face 43 of the carrier sheet 5 through the upper slot 51, FIG. 4A. By moving a lower end of the carrier sheet 5 towards the tapered portion 47 of the carrier sheet 5, a bending 59 of the carrier sheet 5 is provided. The carrier sheet 5 may bend around a bend axis which is parallel to the plane of the carrier sheet 5, and is located approximately between the upper and lower slots 51, 53. This bending 59 makes it possible to insert the vertically lower portion 17 of the belt hanger 7 from the second side face 45 of the carrier sheet 5 through the second slot 53, as illustrated in FIG. 4B. By straightening the flexible carrier sheet 5, the intermediate portion 21 may be positioned between the upper and lower slots 51, 53, extending along the second side face 45 of the carrier sheet 5, as is illustrated in FIG. 4C. The tapered portion 47 of the carrier sheet 5 may be bent or pressed over the ridge 27 of the belt hanger 7 to secure the carrier sheet 5 to the belt hanger 7, as illustrated in FIG. 4D. When the carrier sheet 5 is connected to the belt hanger 7, the vertically lower and upper portions 17, 19 of the belt hanger 7 extend along the first side face 43 of the carrier sheet 5, as is apparent from FIG. 4E.

The design with the intermediate portion 21 on a second side face 45 of the carrier sheet 5, and the vertically upper and lower portions 19, 17 on the opposite first side face 43 of the carrier sheet 5, creates a self-locking between the belt hanger 7 and the carrier sheet 5 when they are connected to each other. If a tool or a tool receiver is connected to the carrier sheet 5, the weight of the tool strives to pull the carrier sheet 5 to a flat/straight position, preventing self-disconnection of the carrier sheet 5 from the belt hanger 7. The carrier sheet 5 may not be disconnected from the belt hanger 7 without the same type of bending as for connection of the carrier sheet 5 to the belt hanger 7.

Figure 5A:
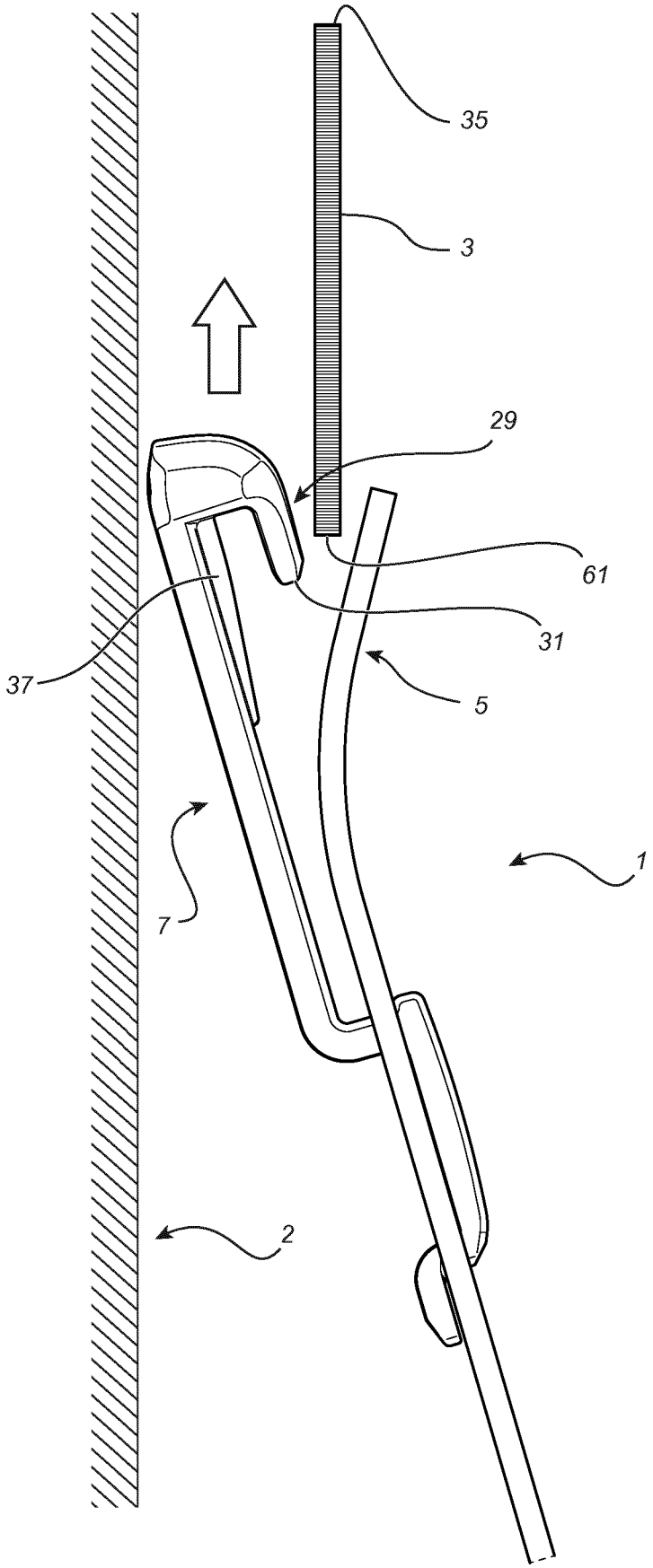
FIGS. 5A-5C show side views of how the tool holder is connected to a tool belt.
Figure 5B:
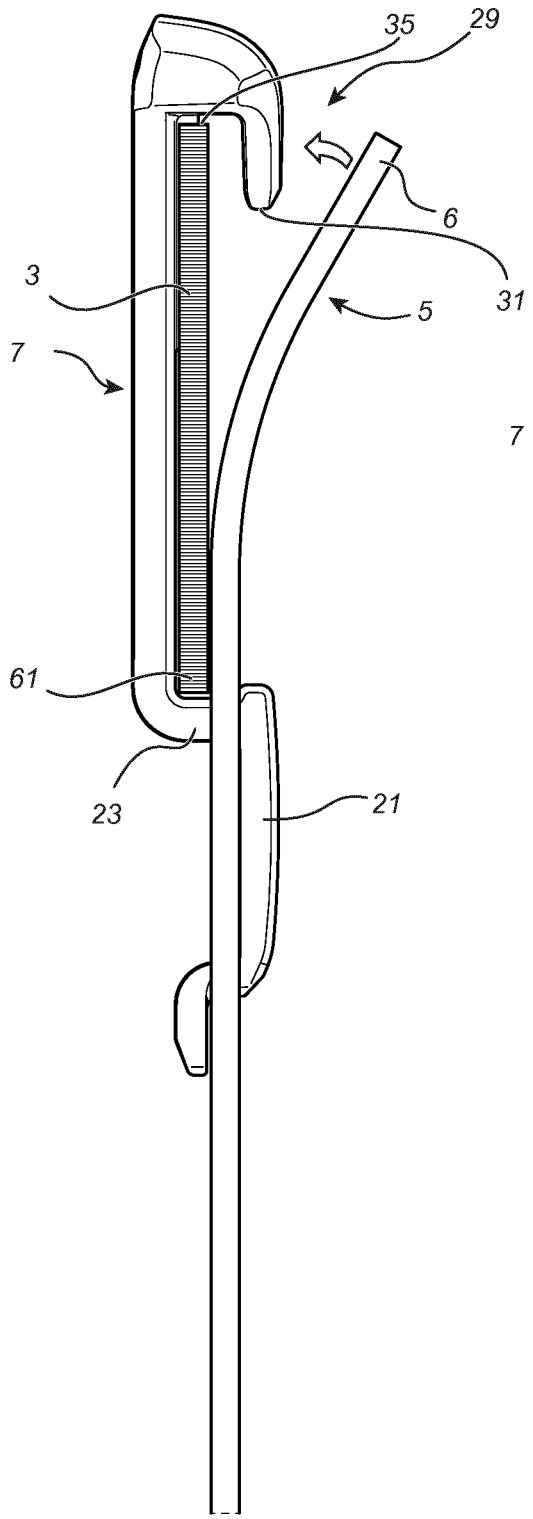
Figure 5C:
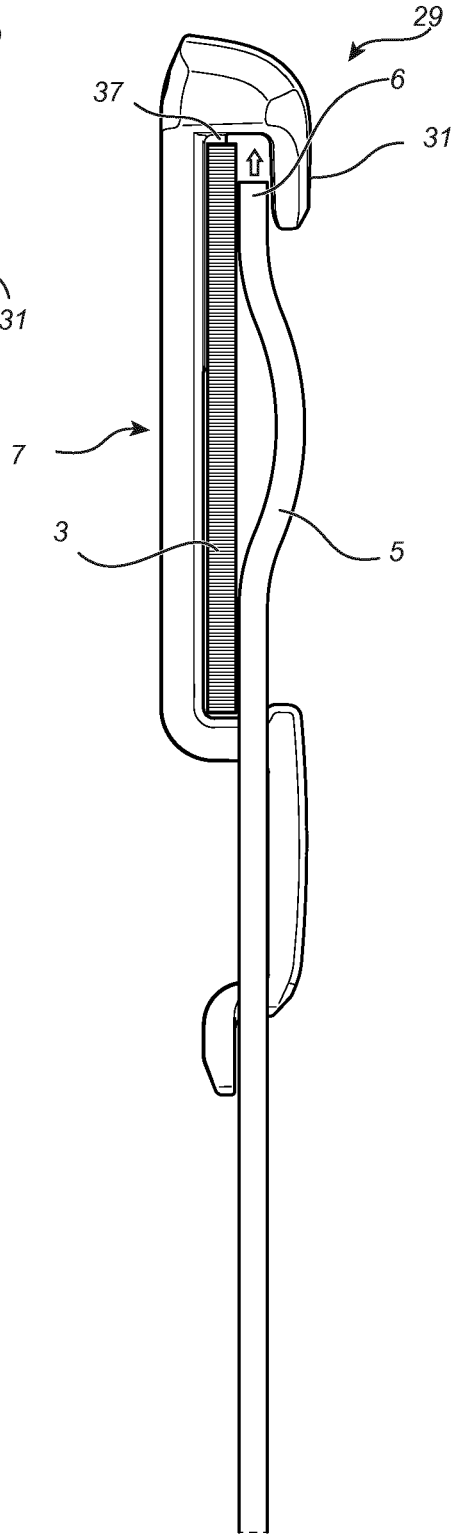

The connection of the tool holder 1 to a tool belt 3 is shown in FIGS. 5A-5C. As is illustrated in FIG. 5A, the belt hanger 7 may be inserted from below between the tool belt 3 and the body 2 of a person carrying the tool belt 3, and the suspension edge 31 of the hook 29 may be hung around an upper edge 35 of the tool belt 3, to arrive at the position illustrated in FIG. 5B. A lower edge 61 of the tool belt 3 may rest against the upper leg 23 of the intermediate portion 21. The belt hanger 7 may be secured to the tool belt 3 by bending and inserting a top portion 6 of the carrier sheet 5 behind the suspension edge 31, to arrive at the position illustrated in FIG. 5C. When the top portion 6 is inserted behind the suspension edge 31, the tool belt 3 is pressed against the gripping element 37. Hence, the tool holder 1 is prevented from sliding sideways along the length of the tool belt 3. The tool holder 1 can also easily be disconnected from and rearranged around the tool belt 3, but it is not likely that the tool holder 1 will be unintentionally disconnected from the tool belt 3.

Figure 6:
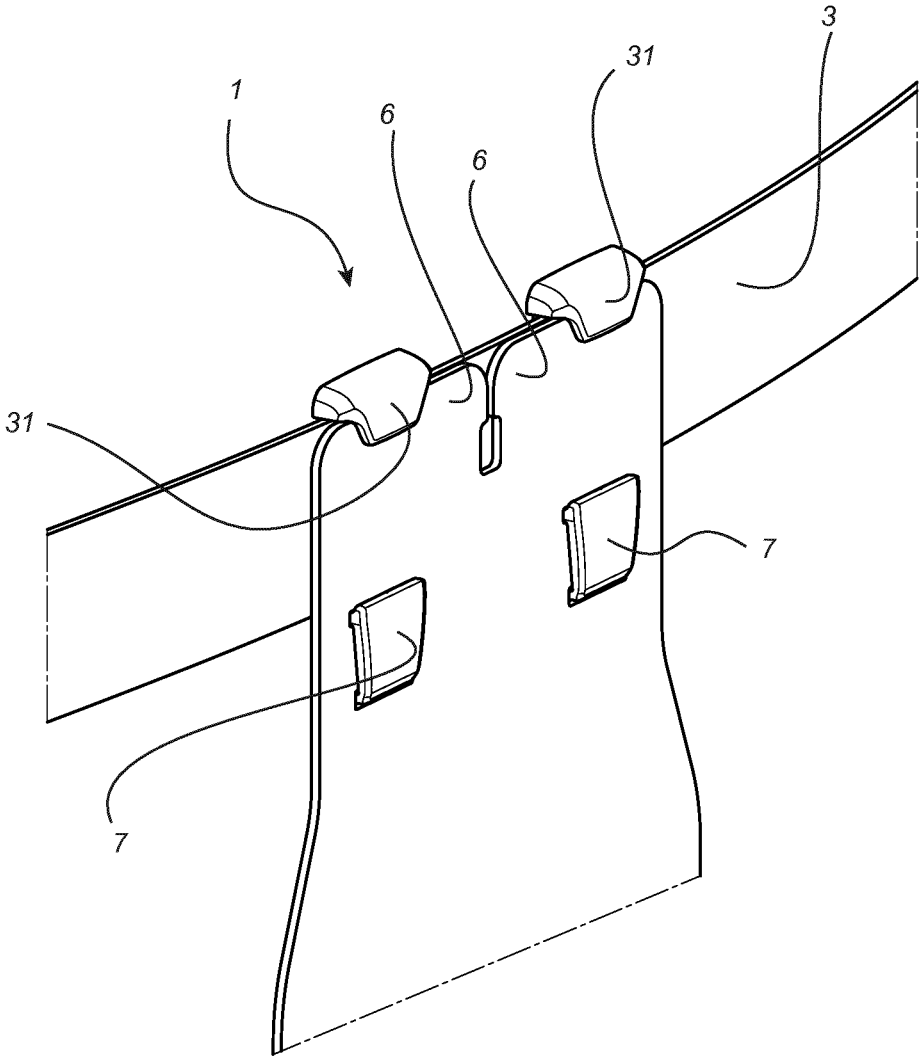
FIG. 6 shows a perspective view of a second embodiment of a tool holder connected to a tool belt.

FIG. 6 shows a tool holder 1 according to s second embodiment connected to a tool belt 3. Big tools or many tools may be arranged within a large pocket. To carry the load from these tools, two or more belt hangers 7 may be connected to a common carrier sheet 5. To facilitate the bending and insertion of the top portion 6 of the carrier sheet 5 behind respective suspension edge 31, the top portion 6 may be partially divided along its vertical length. This makes is possible to have more than one belt hanger 7 connected to the flexible carrier sheet 5 without making the tool holder 1 bulky or stiff.

Figure 7:
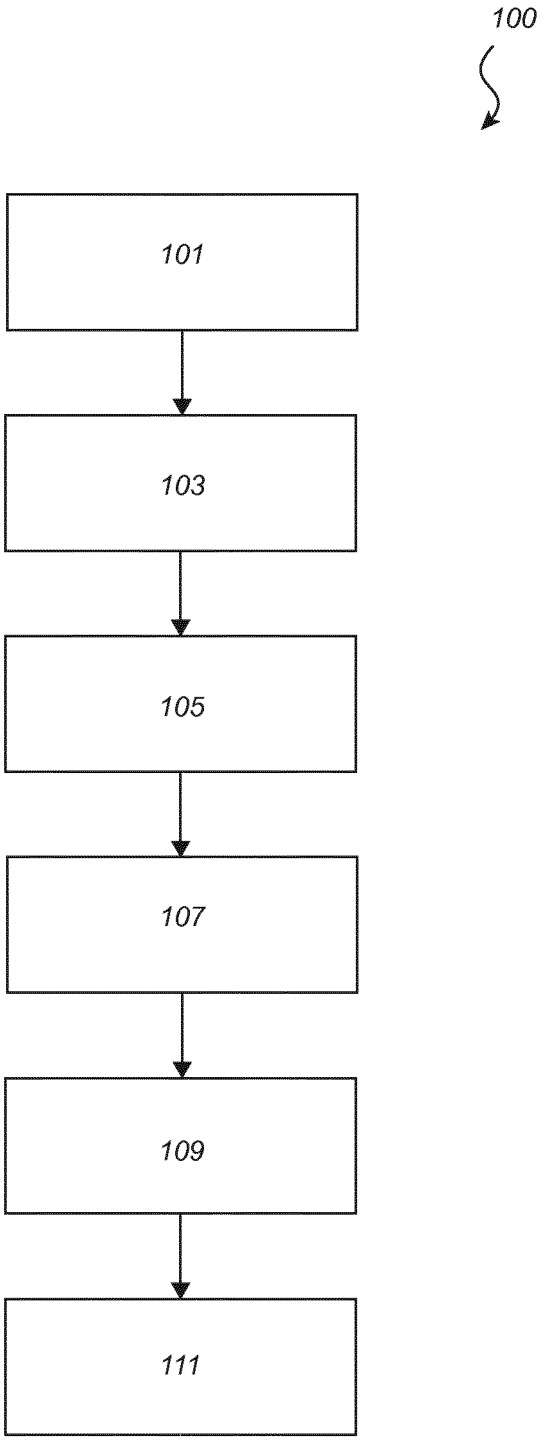
FIG. 7 shows a method for connecting a tool holder to a tool belt.

FIG. 7 illustrates a method 100 for connection of a tool holder to a tool belt. The tool holder may be a tool holder 1 according to the embodiments described with reference to FIG. 1-6. Therefore below, reference is made to FIG. 7, as well as to FIGS. 1-6. The method 100 is a method 100 for connection of a tool holder 1 to a tool belt 3, wherein the tool holder 1 comprises a flexible carrier sheet 5 and at least one belt hanger 7. The method 100 comprises the steps

101: inserting an end of the belt hanger 7 through an upper slot 51 in the flexible carrier sheet 5;

103: bending the flexible carrier sheet 5 towards the belt hanger 7,

105: inserting 105 said end of the belt hanger 7 through a lower slot 53 in the flexible carrier sheet 5; and

107: straightening the bent flexible carrier sheet 5.

109: hanging a suspension edge 31 of the belt hanger 7 around an upper edge 35 of the tool belt 3; and

111: inserting a top portion of a flexible carrier sheet behind the suspension edge 31, between the suspension edge 31 and the tool belt 3.

The invention has mainly been described above with reference to a few embodiments. However, as is readily appreciated by a person skilled in the art, other embodiments than the ones disclosed above are equally possible within the scope of the invention, as defined by the appended patent claims. For example, the belt hanger could have a fixed attachment point for connection of the belt hanger to the carrier sheet instead of the shown carrier sheet connection interface. A protective plate, for protection against sharp tools, such as an axe, or a strap for unburden of arms when carrying heavy objects such as a dunk or a chainsaw can be attached to the carrier sheet as well as tools and tool receivers. The protective plate then serve as the carrier sheet no attachment points are required.

The invention claimed is:

1. A tool holder for a tool belt comprising:

a flexible carrier sheet and at least one belt hanger, wherein said at least one belt hanger comprises a belt interface configured to be connected to a tool belt and a carrier sheet connection interface configured to be connected to the carrier sheet, wherein the flexible carrier sheet comprises a tool suspension interface configured to be connected to a tool or a tool receiver, and a hanger connection interface configured to be connected to the carrier sheet connection interface of the belt hanger, wherein the carrier sheet is configured to bend at the hanger connection interface to operably couple to the belt hanger, wherein the hanger connection interface comprises an upper slot and a lower slot arranged, when carried suspended in a tool belt, one above the other along a vertical length of the carrier sheet, wherein the hanger connection interface comprises a vertically lower portion and a vertically upper portion configured to extend along a first side face of the carrier sheet, and an intermediate portion interconnecting the vertically upper and lower portions, wherein the intermediate portion is offset relative to the upper and lower vertically portions to extend, when connected, along a second side face of the carrier sheet, the second side face being opposite to the first side face, and wherein the belt intermediate portion is configured to be brought to a position between the upper and lower slots responsive to the hanger connection interface being bent.

2. The tool holder according to claim 1, wherein the belt hanger comprises an upper and a lower leg, and wherein the upper leg connects the intermediate portion with the vertically upper portion, and the lower leg connects the intermediate portion with the vertically lower portion.

3. The tool holder according to claim 2, wherein the upper leg is configured to be positioned in the upper slot and the lower leg is configured to be inserted through the lower slot when the carrier sheet is connected to the belt hanger.

4. The tool holder according to claim 1, wherein the intermediate portion further comprises a at least one ridge, configured to secure the carrier sheet to the belt hanger by pressing or bending the hanger connection interface over the at least one ridge.

5. The tool holder according to claim 1, wherein the belt interface comprises a hook provided with a suspension edge extending, when in use, vertically downwards from a top portion of the belt hanger, and wherein the suspension edge is configured to be hung around an upper part of the tool belt.

6. The tool holder according to claim 5, wherein the carrier sheet further comprises a top portion configured to secure the belt hanger to the tool belt responsive to the top portion being bent and operably coupled to the belt hanger behind the suspension edge.

7. The tool holder according to claim 1, wherein the belt interface further comprises a gripping element configured to engage with the tool belt to clamp the tool belt to the belt hanger when the belt hanger is connected at the tool belt.

8. The tool holder according to claim 7, wherein the top portion of the carrier sheet is configured to squeeze the tool belt against the gripping element when the top portion of the carrier sheet is inserted behind the suspension edge.

9. The tool holder according to claim 1, wherein the belt hanger is rigid.

10. The tool holder according to claim 1, wherein the tool suspension interface comprises several attachment points adapted for connection of a tool or a tool receiver to the carrier sheet.

11. A method for connecting a tool holder to a tool belt, wherein the tool holder comprises a flexible carrier sheet and at least one belt hanger, the method comprising the steps of:

inserting an end of the belt hanger through an upper slot in the flexible carrier sheet;

bending the flexible carrier sheet towards the belt hanger;

inserting said end of the belt hanger through a lower slot in the flexible carrier sheet;

straightening the bent flexible carrier sheet;

hanging a suspension edge of the belt hanger around an upper edge of the tool belt; and inserting a top portion of a flexible carrier sheet behind the suspension edge, between the suspension edge and the tool belt.

* * * * *